US010559897B1

(12) United States Patent
Rangi et al.

(10) Patent No.: US 10,559,897 B1
(45) Date of Patent: Feb. 11, 2020

(54) PUSH-IN ELECTRICAL TERMINAL WITH INSULATION CONTACT

(71) Applicant: Lear Corporation, Southfield, MI (US)

(72) Inventors: Bhupinder Rangi, Novi, MI (US); David Menzies, Linden, MI (US); Michael Glick, Farmington Hills, MI (US); Lewis Galligan, Novi, MI (US); Sheikh Habibur Rahman, Macomb, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 16/124,588

(22) Filed: Sep. 7, 2018

(51) Int. Cl.
*H01R 4/48* (2006.01)
*H01R 4/58* (2006.01)

(52) U.S. Cl.
CPC ..... *H01R 4/4818* (2013.01); *H01R 4/58* (2013.01)

(58) Field of Classification Search
CPC ..... H01R 4/48; H01R 4/58; H01R 4/245
See application file for complete search history.

(56) References Cited

U.S. PATENT DOCUMENTS 3,656,093 A * 4/1972 Kinkaid ..... H01R 12/721 439/636
5,551,150 A * 9/1996 Zielinski ..... H01R 13/187 29/882
5,954,535 A 9/1999 Lawrence
6,074,242 A 6/2000 Stefaniu et al.
6,682,364 B2 1/2004 Cisey
7,083,463 B2 8/2006 Steinkemper et al.
7,097,497 B2 8/2006 Kikuchi
7,927,127 B1 4/2011 Glick et al.
8,128,426 B2 3/2012 Glick et al.
8,408,952 B2 * 4/2013 Wu ..... H01R 4/4818 439/441
8,485,841 B2 7/2013 Schrader
8,579,651 B2 11/2013 Hanning et al.
8,616,926 B2 * 12/2013 Byrne ..... H01R 11/22 439/861
9,577,381 B2 * 2/2017 Shi ..... H01R 13/639

* cited by examiner

*Primary Examiner* — Xuong M Chung Trans
(74) *Attorney, Agent, or Firm* — MacMillan, Sobanski & Todd, LLC

(57) ABSTRACT

An electrical terminal includes a terminal base. A mate portion is attached to the terminal base. The mate portion is adapted to mate with a corresponding electrical terminal. The electrical terminal includes a conductor contact portion. The conductor contact portion includes a box attached to the terminal base. A lever extends from one wall of the box. The lever is curved to extend toward the terminal base. The lever is adapted to engage a conductor of a wire inserted into the box. The electrical terminal also includes an insulation contact portion. The insulation contact portion is attached to the terminal base. The insulation contact portion is adapted to engage an insulation of the wire.

17 Claims, 4 Drawing Sheets

PUSH-IN ELECTRICAL TERMINAL WITH INSULATION CONTACT

BACKGROUND OF THE INVENTION

This invention relates to an electrical terminal. More specifically, this invention relates to an electrical terminal with a push-in connection for an electrical wire.

Electrical terminals are normally used in matching pairs in order to allow electrical connections to be made between electrical wires or electrical devices. A typical electrical terminal is made of an electrically-conductive material and includes a mate portion that engages the matching electrical terminal and a contact portion that engages the electrical wire. In order to provide a desired flow of electrical current between the wire and the electrical terminal, the contact portion provides an electrical connection between the electrical terminal and a conductor portion of the electrical wire. Additionally, in order to prevent the wire from pulling away from the electrical terminal, the contact portion maintains a physical connection with the electrical wire.

Common types of connections used in the contact portion include crimped, welded, or push-in connections. It would be advantageous to have an alternative electrical terminal with a push-in connection.

SUMMARY OF THE INVENTION

The invention relates to an electrical terminal. The electrical terminal includes a terminal base. A mate portion is attached to the terminal base. The mate portion is adapted to mate with a corresponding electrical terminal. The electrical terminal includes a conductor contact portion. The conductor contact portion includes a box attached to the terminal base. A lever extends from one wall of the box. The lever is curved to extend toward the terminal base. The lever is adapted to engage a conductor of a wire inserted into the box. The electrical terminal also includes an insulation contact portion. The insulation contact portion is attached to the terminal base. The insulation contact portion is adapted to engage an insulation of the wire.

In another embodiment, the electrical terminal includes a terminal base with a mate portion attached to the terminal base. The mate portion is adapted to mate with a corresponding electrical terminal. A conductor contact portion is also attached to the terminal base. The conductor contact portion is adapted to engage a conductor of a wire. An insulation contact portion is also attached to the terminal base. The insulation contact portion is adapted to engage an insulation of the wire. The insulation contact portion includes a wire contact with a fixed end that is attached to the terminal base and a free end that is movable relative to the terminal base.

Various aspects of this invention will become apparent to those skilled in the art from the following detailed description of the preferred embodiments, when read in light of the accompanying drawings.

DETAILED DESCRIPTION OF THE PREFERRED EMBODIMENTS

Figure 1:
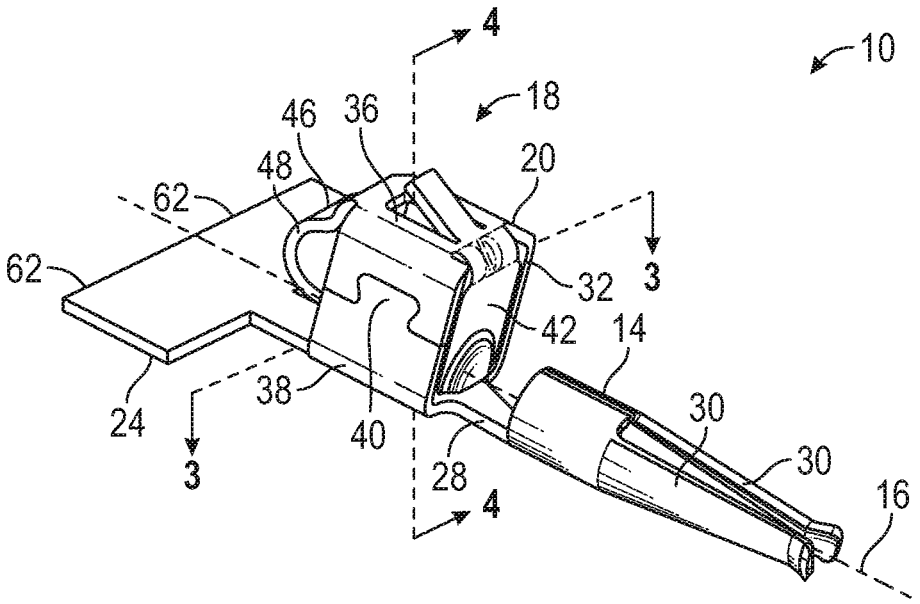
FIG. 1 is a perspective view of a first embodiment of an electrical terminal that includes a push-in wire connector.
Figure 2:
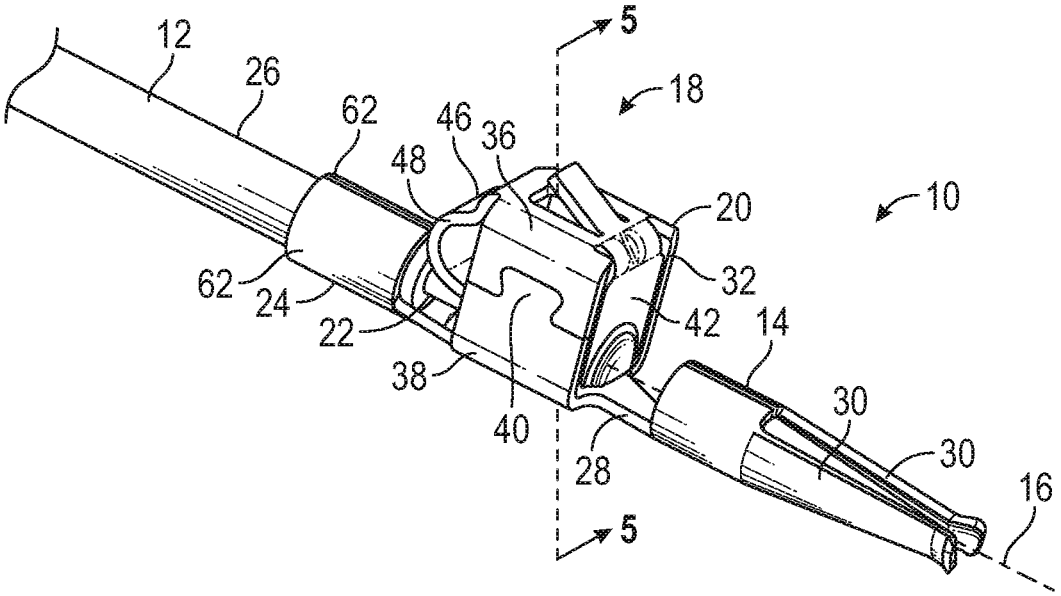
FIG. 2 is a view similar to FIG. 1 showing the electrical terminal connected to a wire.

Referring now to the drawings, there is illustrated in FIG. 1 a perspective view of a first embodiment of an electrical terminal in accordance with the invention, indicated generally at 10. The illustrated electrical terminal 10 is made from a single sheet of metal, stamped and folded into the configuration shown. However, the electrical terminal 10 may be made from any desired material and by any desired process. FIG. 2 is a view similar to FIG. 1 showing the electrical terminal 10 connected to an insulated wire 12.

The electrical terminal 10 includes a mate portion 14 that is configured to be mated with a corresponding electrical terminal (not shown). The illustrated mate portion 14 is a two-armed female terminal that is configured to mate with a male pin-type terminal inserted along a terminal axis 16. However, the mate portion 14 may be any desired type of connection.

The electrical terminal 10 also includes a contact portion, indicated generally at 18, that is configured to engage the wire 12. The contact portion 18 includes a conductor contact portion 20, which is configured to engage a conductor 22 of the wire 12 to provide electrical contact between the electrical terminal 10 and the conductor 22. The contact portion 18 also includes an insulation contact portion 24 that is configured to engage an insulator 26 of the wire 12. The contact portion 18 is a push-in type connector and will be described in greater detail below. The illustrated insulation contact portion 24 is configured to be crimped onto the wire 12, but may be any desired type of connection.

Figure 3:
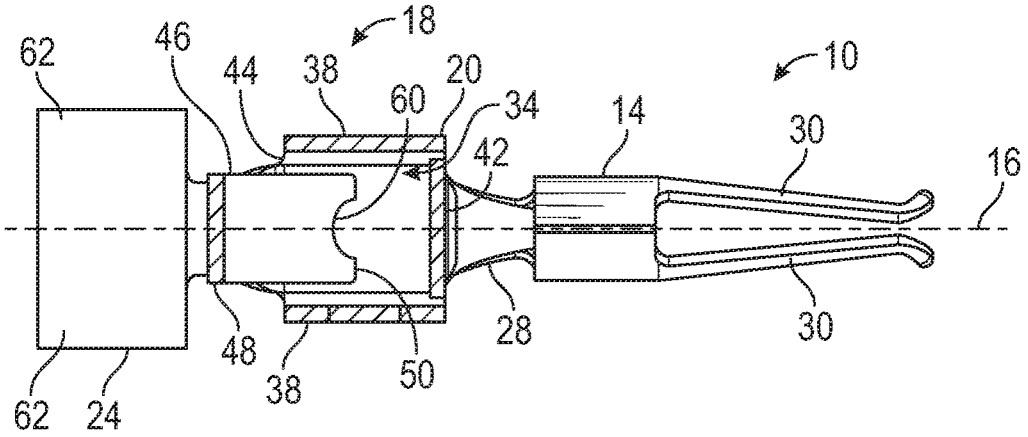
FIG. 3 is a cross-sectional view of the electrical terminal taken along the line 3-3 of FIG. 1.
Figure 4:
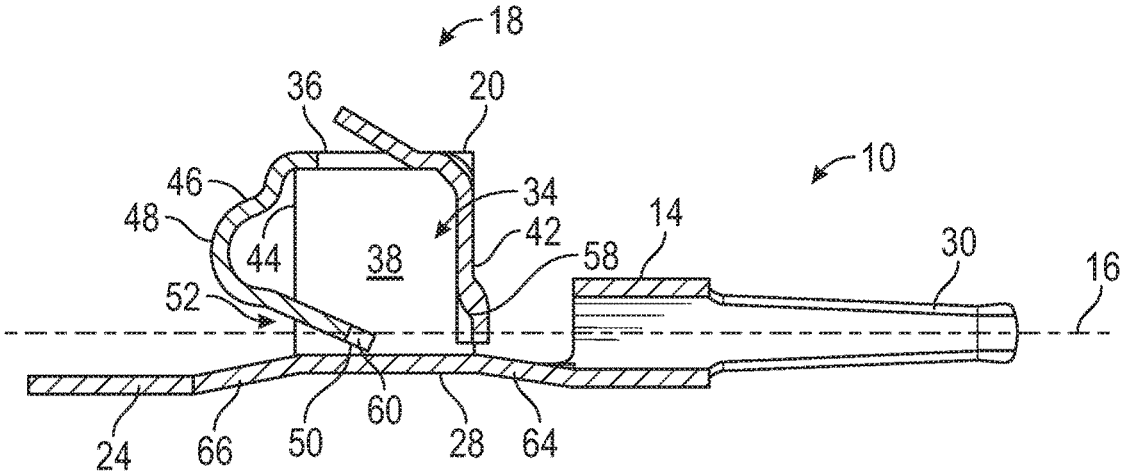
FIG. 4 is a cross-sectional view of the electrical terminal taken along the line 4-4 of FIG. 1.
Figure 5:
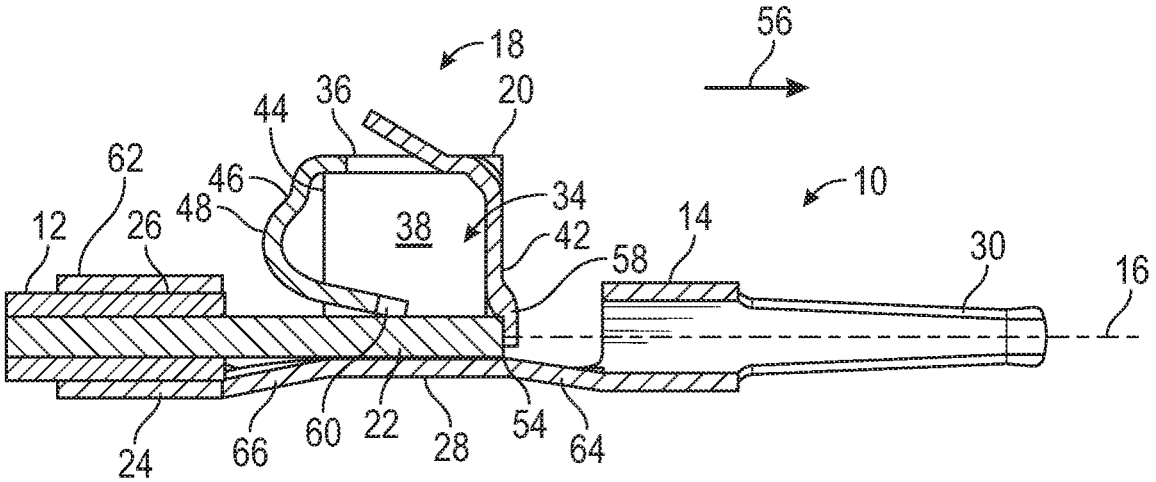
FIG. 5 is a cross-sectional view of the electrical terminal and wire taken along the line 5-5 of FIG. 2.

FIG. 3 is a cross-sectional view of the electrical terminal 10 taken along the line 3-3 of FIG. 1, and FIG. 4 is a cross-sectional view of the electrical terminal 10 taken along the line 4-4 of FIG. 1, perpendicular to the view shown in FIG. 3. FIG. 5 is a view similar to FIG. 4 taken along the line 5-5 of FIG. 2 and showing the electrical terminal 10 connected to the wire 12.

The electrical terminal 10 includes a terminal base 28. The illustrated terminal base 28 is a continuous piece that extends from the mate portion 14 through the conductor contact portion 20 to the insulation contact portion 24. The mate portion 14 includes two terminal arms 30 that extend from the terminal base 28 and are located on opposed sides of the terminal axis 16.

The conductor contact portion 20 includes a box 32 that extends from the terminal base 28. The box 32 defines an interior space, indicated generally at 34. The illustrated box 32 is positioned so that the terminal axis 16 extends through the interior space 34. The illustrated box 32 includes an outer wall 36 that is located on an opposed side of the interior space 34 from the terminal base 28. Two side walls 38 are located on opposed sides of the interior space 34 and extend from the terminal base 28 to the outer wall 36. In the illustrated embodiment, one of the side walls 38 includes a dovetail lock 40 (best shown in FIGS. 1 and 2). The dovetail lock 40 helps retain the box 32 in its assembled state. However, the box 32 may be held together by any desired connector or mechanism.

The conductor contact portion 20 also includes a front wall 42 that is located between the interior space 34 and the mate portion 14. In the illustrated embodiment, the front wall 42 is made from pieces of material that are folded from the outer wall 36 toward the terminal base 28. However, the front wall 42 may extend from any desired part of the electrical terminal 10. The box 32 includes an open side 44 which allows for insertion of the wire 12 into the interior space 34, as will be described below. In the illustrated embodiment, the open side 44 is located opposite the front wall 42, but may be on any desired portion of the box 32.

The conductor contact portion 20 includes a lever 46 that serves to engage the wire 12, as will be described below. The illustrated lever 46 is stamped from the same piece of material as the rest of the electrical terminal 10, but the lever 46 may be a separate component if desired. The illustrated lever 46 extends from the outer wall 36 of the box 32 but may extend from any desired part of the electrical terminal 10. The lever 46 extends from the box 32, and at least a portion of the lever 46 is located outside the interior space 34 of the box 32. The lever 46 extends through the open side 44 of the box 32 into the interior space 34. The lever 46 includes a curve portion 48 where the lever 46 is bent so that the extended portion of the outer wall 36 extends into the interior space 34. The curve portion 48 may have any desired size or curvature.

The lever 46 extends from the outer wall 36 toward the opposed side of the box 32. In the illustrated embodiment, the lever 46 extends from the outer wall 36 toward the terminal base 28. However, the lever 46 may extend toward any desired part of the electrical terminal 10. The lever 46 includes an engagement edge 50, which is the part of the lever 46 that is nearest the terminal base 28. The engagement edge 50 is the part of the lever 46 that engages the wire 12, as will be described the below. In the illustrated embodiment, the engagement edge 50 is a distal end of the lever 46, but may be any desired part of the lever 46. The engagement edge 50 of the lever 46 is located in the interior space 34 of the box 32.

The lever 46 and the terminal base 28 define an insertion channel, indicated generally at 52, therebetween. The insertion channel 52 extends from the engagement edge 50 of the lever 46 toward the open side 44 of the box 32. The illustrated insertion channel 52 is wedge-shaped, being widest at the open side 44 and narrowest at the engagement edge 50, although such is not required.

As shown in the FIG. 5, the wire 12 includes an exposed end 54 where a portion of the conductor 22 is exposed by removal of a portion of the insulator 26 from the wire 12. To attach the electrical terminal 10 to the wire 12, the wire 12 is initially positioned on the terminal axis 16 and is then moved relative to the electrical terminal 10 in an insertion direction 56 parallel to the terminal axis 16. The exposed end 54 of the conductor 22 is thus moved through the open side 44 of the box 32 into the insertion channel 52. The conductor 22 engages the lever 46 and pushes the lever 46 away from the terminal base 28. The wire 12 is moved farther in the insertion direction 56 until the conductor 22 engages a wire stop 58 on the box 32, which prevents further movement of the conductor 22 in the insertion direction 56. In the illustrated embodiment, the wire stop 58 is a portion of the front wall 42.

Once attached, the conductor 22 of the wire 12 is located between the lever 46 and the terminal base 28. The engagement edge 50 of the lever 46 engages the conductor 22, and the resilient lever 46 presses against the conductor 22. The lever 46 also presses the conductor 22 against the terminal base 28. The illustrated lever 46 includes a conductor notch 60 on the engagement edge 50. The illustrated conductor notch 60 is a cut-out portion of the engagement edge 50 of the lever 46 that has a generally semi-circular shape, as best seen in FIG. 3. The conductor 22 is located partially in the conductor notch 60, which increases the contact area between the lever 46 and the conductor 22. The engagement of the conductor 22 with the lever 46 and the terminal base 28 provides an electrical connection between the conductor 22 and the electrical terminal 10.

The engagement of the conductor 22 with the lever 46 and the terminal base 28 also resists the wire 12 being removed from the electrical terminal 10. If a force is applied to move the wire 12 opposite the insertion direction 56 relative to the electrical terminal 10, the lever 46 will be pulled opposite the insertion direction 56 and will pinch the conductor 22 between the lever 46 and the terminal base 28.

The insulation contact portion 24 also resists the wire 12 being removed from the electrical terminal 10. The illustrated insulation contact portion 24 includes two crimp arms 62 that extend from the terminal base 28. The illustrated crimp arms 62 are attached to a portion of the wire 12 by ultrasonic welding. However, the crimp arms 62 may be attached to the wire 12 using any desired method.

In the illustrated embodiment, the distance between the terminal axis 16 and the terminal base 28 is different at different parts of the electrical terminal 10. The terminal base 28 includes a mate offset 64 that is located between the mate portion 14 and the conductor contact portion 20. In the conductor contact portion 20, the terminal base 28 is closer to the terminal axis 16 than it is in the mate portion 14. Additionally, the terminal base 28 includes a contact offset 66 that is located between the conductor contact portion 20 and the insulation contact portion 24. In the conductor contact portion 20, the terminal base 28 is closer to the terminal axis 16 than it is in the insulation contact portion 20. The offsets 64 and 66 allow the wire 12 to be positioned on the terminal base 28 while being coaxial with the terminal axis 16. The particular size of the offsets 64 and 66 can be selected depending on the relative sizes of the terminal arms 30, the conductor 22, and the insulator 26.

Figure 6:
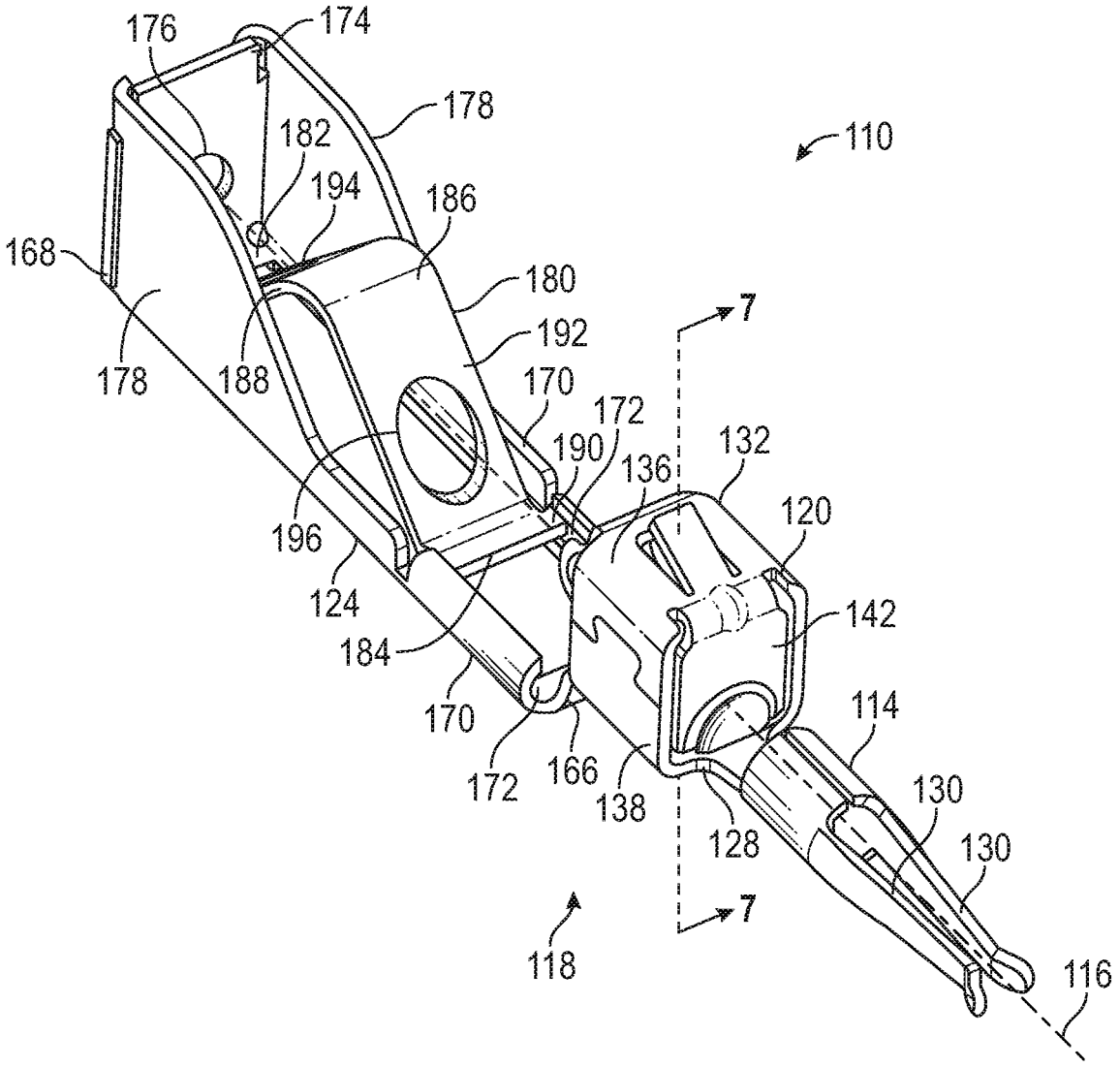
FIG. 6 is a perspective view of a second embodiment of an electrical terminal with a push-in wire connector.

Referring to FIG. 6, there is shown a perspective view of a second embodiment of an electrical terminal in accordance with the invention, indicated generally at 110. The illustrated electrical terminal 110 is made from a single sheet of metal, stamped and folded into the configuration shown. However, the electrical terminal 110 may be made from any desired material and by any desired process. The electrical terminal 110 includes a mate portion 114 and a conductor contact portion 120 that are substantially the same as the previously-described electrical terminal 10. These parts of the electrical terminal 110 will not be described in detail, but similar components are identified on the drawings by the same reference number increased by 100. The electrical terminal 110 includes an insulation contact portion 124 that will be described in greater detail.

The electrical terminal 110 includes a terminal base 128 that extends from the conductor contact portion 120 to the insulation contact portion 124. The terminal base 128 includes an offset that is 166 located between the conductor contact portion 120 and the insulation contact portion 124. In the conductor contact portion 120, the terminal base 128 is closer to a terminal axis 116 than it is in the insulation contact portion 124. The insulation contact portion 124 extends from the offset 166 to an insertion end 168 of the electrical terminal 110.

The insulation contact portion 124 includes two struts 170 that extend between the offset 166 and the insertion end 168. The illustrated struts 170 are mirror-images of each other, but may have different shapes if desired. Each strut includes a guide channel 172. The guide channels 172 are C-shaped paths that open facing toward each other. Each of the guide channels 172 is defined by part of the material of the respective strut 170 that is folded inwardly. Each of the guide channels 172 extends parallel to the terminal axis 116.

The electrical terminal 110 includes a terminal wall 174 at the insertion end 168 that is attached to the struts 170. The illustrated terminal wall 174 is generally perpendicular to the terminal axis 116, but may have any desired orientation. An insertion opening 176 is located in the terminal wall 174, and the terminal axis 116 passes through the insertion opening 176. The illustrated insertion opening 176 has a circular shape, but may have any desired shape. The insulation contact portion 124 includes two side walls 178 that are connected to the terminal wall 174 and are located on opposed sides of the terminal axis 116. Each of the side walls 178 is connected to the one of the struts 170 and provides increased strength to the insulation contact portion 124.

Figure 7:
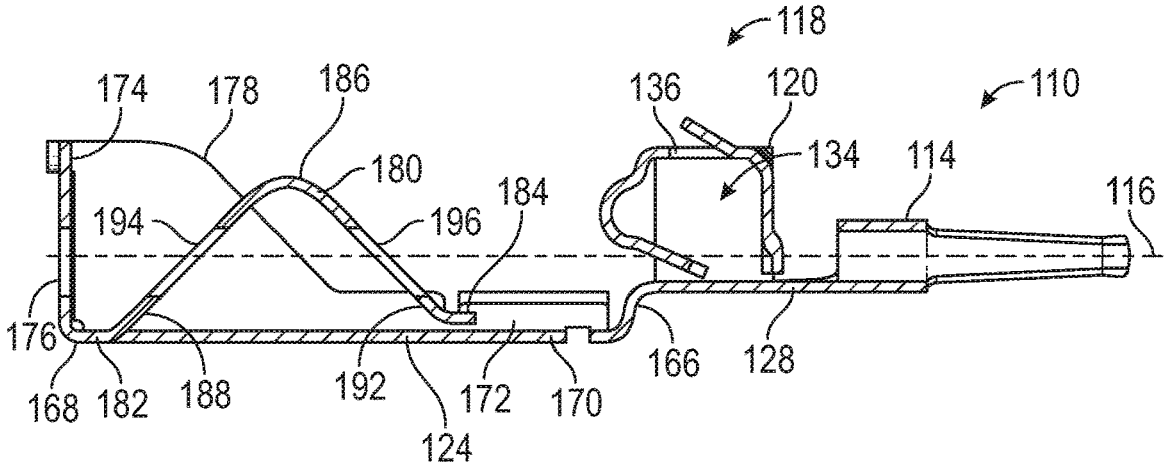
FIG. 7 is a cross-sectional view of the electrical terminal taken along the line 7-7 of FIG. 6.

The insulation contact portion 124 includes a resilient, V-shaped wire contact 180. The wire contact 180 includes a fixed end 182, a free end 184, and an intermediate peak 186. Some features of the wire contact 180 are best seen in FIG. 7, which is a cross-sectional view taken along the line 7-7 of FIG. 6.

The fixed end 182 of the wire contact 180 is attached to the struts 170 near the insertion end 168 of the electrical terminal 110. The fixed end 182 is located between the two side walls 178, and a first wing 188 of the wire contact 180 extends from the fixed end 182 between the two side walls 178 to the peak 186.

The free end 184 of the wire contact 180 includes two guide tabs 190 (only one is shown in FIG. 6) that extend from opposed sides of the free end 184. Each of the guide tabs 190 is located in one of the guide channels 172. The guide tabs 190 are not fixed to the struts 170 and, thus, are able to move in the respective guide channel 172 relative to the struts 170 in a direction generally parallel to the terminal axis 116. A second wing 192 of the wire contact 180 extends from the free end 184 to the peak 186.

The peak 186 is a curved portion of the wire contact 180 located where the first wing 188 and the second wing 192 meet. In the illustrated embodiment, the peak 186 and the terminal base 128 are located on opposed sides of the terminal axis 116. The peak 186 may have any desired shape or orientation.

The wire contact 180 includes a first wire contact opening 194 that extends through the first wing 188. The first wire contact opening 194 has an elliptical shape, but may have any desired shape. The terminal axis 116 passes through the center of the illustrated first wire contact opening 194, but the first wire contact opening 194 may be in any desired position. The wire contact 180 also includes a second wire contact opening 196 that extends through the second wing 192. The second wire contact opening 196 has an elliptical shape, but may have any desired shape. The terminal axis 116 passes through the center of the illustrated second wire contact opening 196, but the second wire contact opening 196 may be in any desired position.

Figure 8:
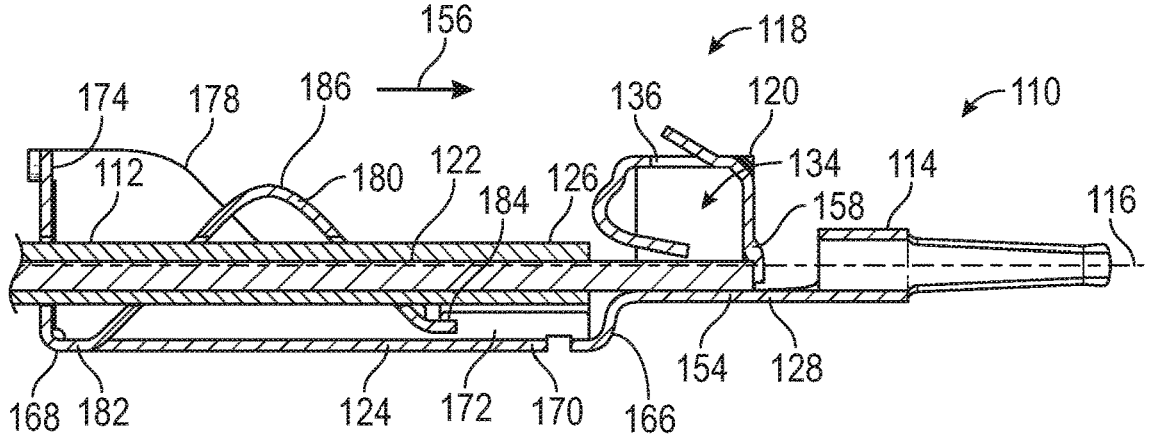
FIG. 8 is a cross-sectional view similar to FIG. 7 showing a wire connected to the electrical terminal.

FIG. 8 is a view similar to FIG. 7, with a wire 112 shown in an inserted position on the electrical terminal 110. The wire 112 is an insulated wire and includes a conductor 122 and an insulation 126. The wire 112 includes an exposed end 154 where a portion of the conductor 122 is exposed. The wire 112 is moved into the inserted position by moving the exposed end 154 of the wire 112 relative to the electrical terminal 110 through the insertion opening 176, through the first wire contact opening 194, through the second wire contact opening 196, and into the conductor contact portion 120. The conductor 122 is connected to the conductor contact portion 120 similarly to the way the conductor 22 is connected to the previously-described conductor contact portion 20, and will not be described in detail.

Figure 9:
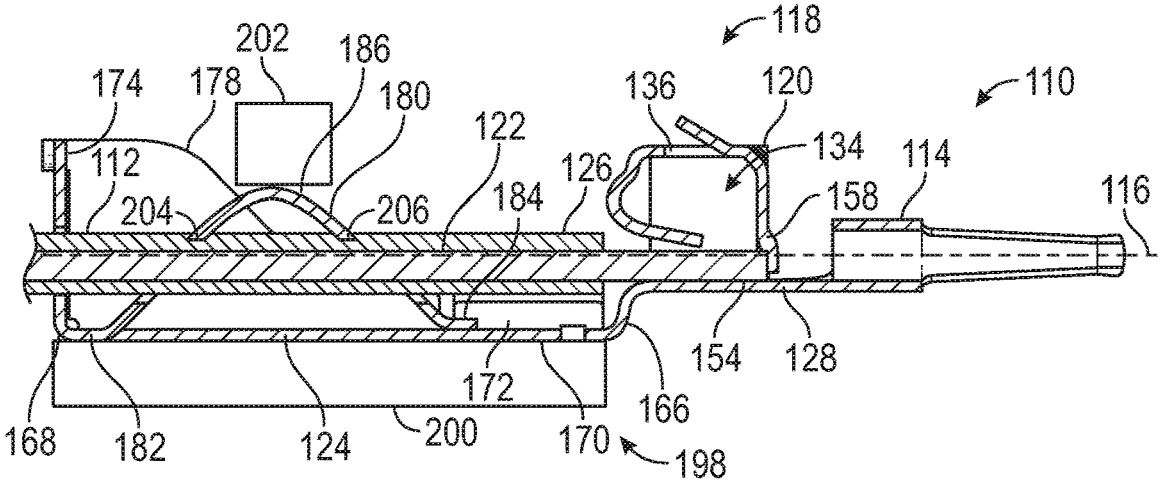
FIG. 9 is a cross-sectional view similar to FIG. 8 showing the electrical terminal seated in a connector.

FIG. 9 is a view similar to FIG. 8, with the electrical terminal 110 shown in a seated position in a housing, indicated generally at 198. The illustrated housing 198 includes a terminal support 200, which is engaged with a portion of the terminal base 128, and a wire lock 202, which is engaged with a portion of the wire contact 180. The illustrated terminal support 200 and wire lock 202 are located on opposed sides of the terminal axis 116, but may have any desired relative positions.

The wire lock 202 engages the peak 186 of the wire contact 180 and pushes the peak 186 toward the terminal base 128. As a result, the free end 154 of the wire contact 180 is pushed away from the insertion end 168 of the electrical terminal 110. The guide tabs 190 located in the guide channels 172 restrict how far the free end 154 is able to move away from the terminal axis 116. In the illustrated embodiment, when the wire 112 is in the inserted position, the portions of the wire 112 in the wire contact openings 194 and 196 include the insulation 126. When the electrical terminal 110 is in the seated position, the first wing 188 and the second wing 192 are moved so that a first engagement edge 204 and a second engagement edge 206 are pushed into the insulation 126 of the wire 112. The engagement edges 204 and 206 are the portions of the wings 188 and 192 defining the sides of the wire contact openings 194 and 196, nearest the peak 186. The wire contact 180 is made of a harder material than the insulation 126, and the insulation 126 is displaced by the engagement edges 204 and 206.

When the electrical terminal 110 is in the seated position, the insulation contact portion 124 resists the wire 112 being removed from the electrical terminal 110. A force applied to move the wire 112 away from the electrical terminal 110 will be resisted by the engagement of the wire contact 180 with the insulation 126 of the wire 112. If desired, the wire contact 180 may engage with the conductor 120 of the wire 112.

The principle and mode of operation of this invention have been explained and illustrated in its preferred embodiments. However, it must be understood that this invention may be practiced otherwise than as specifically explained and illustrated without departing from its spirit or scope.

What is claimed is:

1. An electrical terminal comprising:

a terminal base;

a mate portion attached to the terminal base and adapted to mate with a corresponding electrical terminal;

a conductor contact portion including a box attached to the terminal base and a lever extending from a wall of the box, the lever being curved to extend toward the terminal base and adapted to engage a conductor of a wire inserted into the box; and an insulation contact portion attached to the terminal base and adapted to engage an insulation of the wire, wherein the insulation contact portion includes a wire contact with a fixed end that is attached to the terminal base and a free end that is movable relative to the terminal base, and the wire contact includes a first wing with a first wire contact opening and a second wing with a second wire contact opening, a terminal axis extending through the first wire contact opening and the second wire contact opening into an interior space of the box.

2. The electrical terminal of claim 1, wherein the lever includes an engagement edge that is adapted to engage the conductor, and wherein the engagement edge is located within an interior space defined by the box.

3. The electrical terminal of claim 2, further comprising a wire stop located between the interior space and the mate portion.

4. The electrical terminal of claim 3, wherein the mate portion is adapted to mate with the corresponding electrical terminal along the terminal axis, and wherein the terminal axis extends through the wire stop.

5. The electrical terminal of claim 4, further comprising an offset on the terminal base located between the conductor contact portion and the insulation contact portion so that the terminal base in the conductor contact portion is closer to the terminal axis than it is in the insulation contact portion.

6. The electrical terminal of claim 5, further comprising a mate offset on the terminal base located between the conductor contact portion and the mate portion so that the terminal base in the conductor contact portion is closer to the terminal axis than it is in the mate portion.

7. The electrical terminal of claim 1, wherein the terminal axis extends into the interior space between the terminal base and the lever.

8. The electrical terminal of claim 7, wherein the terminal axis extends into a wire stop that is located between the interior space and the mate portion.

9. The electrical terminal of claim 1, wherein the wire contact includes a peak located between the first wing and the second wing.

10. The electrical terminal of claim 1, wherein the wire contact includes a guide tab on the free end, the guide tab located in a guide channel located on the terminal base.

11. The electrical terminal of claim 10, wherein the guide channel extends substantially parallel to the terminal axis.

12. The electrical terminal of claim 11, further comprising a terminal wall located at an insertion end of the insulation contact portion, opposite the conductor contact portion.

13. The electrical terminal of claim 12, further comprising an insertion opening in the insertion wall, wherein the terminal axis extends through the insertion opening.

14. An electrical terminal comprising:

a terminal base;

a mate portion attached to the terminal base and adapted to mate with a corresponding electrical terminal;

a conductor contact portion attached to the terminal base and adapted to engage a conductor of a wire; and an insulation contact portion attached to the terminal base and adapted to engage an insulation of the wire, the insulation contact portion including a wire contact with a fixed end that is attached to the terminal base and a free end that is movable relative to the terminal base, wherein the wire contact includes a first wing with a first wire contact opening and a second wing with a second wire contact opening, and a terminal axis extends through the first wire contact opening and the second wire contact opening.

15. The electrical terminal of claim 14, wherein the wire contact includes a peak located between the first wing and the second wing.

16. The electrical terminal of claim 14, wherein the wire contact includes a guide tab on the free end, the guide tab located in a guide channel located on the terminal base.

17. The electrical terminal of claim 16, wherein the guide channel extends substantially parallel to the terminal axis.

* * * * *